United States Patent [19]

Alfing

[11] Patent Number: 4,983,237

[45] Date of Patent: Jan. 8, 1991

[54] ANTENNA LAMINATION TECHNIQUE

[75] Inventor: Norman L. Alfing, Green Valley, Ariz.

[73] Assignee: Hughes Aircraft Company, Los Angeles, Calif.

[21] Appl. No.: 233,405

[22] Filed: Aug. 18, 1988

[51] Int. Cl.[5] ..... B41M 5/00

[52] U.S. Cl. ..... 156/83; 343/785; 343/911 R; 343/708; 29/600; 219/121.63

[58] Field of Search ..... 343/785, 708, 784, 911 R; 29/600; 333/239, 240; 428/68, 99; 156/83, 92, 293, 308.2, 272.8; 219/121.63, 121.64

[56] References Cited

U.S. PATENT DOCUMENTS

| | | | |
|---|---|---|---|
| H680 | 9/1989 | Alfing et al. | 343/785 |
| 2,761,137 | 8/1956 | Atta et al. | 343/785 |
| 3,686,590 | 8/1972 | Dischert | 333/24.1 |
| 3,798,652 | 3/1974 | Williams | 343/708 |
| 3,798,653 | 3/1974 | Jones, Jr. | 343/785 |
| 4,010,470 | 3/1977 | Jones, Jr. | 343/708 |
| 4,316,923 | 2/1982 | Monforte et al. | 29/600 |
| 4,618,865 | 10/1986 | Lamensdorf et al. | 343/785 |
| 4,760,240 | 7/1988 | Iikawa et al. | 219/121.64 |

FOREIGN PATENT DOCUMENTS

| | | | |
|---|---|---|---|
| 3234825 | 3/1984 | Fed. Rep. of Germany | 343/785 |
| 0032806 | 4/1981 | Japan | 343/785 |
| 0054502 | 3/1985 | Japan | 29/600 |

OTHER PUBLICATIONS

Jones,Jr. "Miniaturized Dielectric Loaded Waveguide Antenna"; HDL Technical Disclosure Bulletin, No. 3.

Angelako, "Radiation From Ferrite-Filled Apertures", Proceedings of the IRE, vol. 44, No. 10, Oct. 1956.

*Primary Examiner*—Rolf Hille

*Assistant Examiner*—Hoanganh Le

*Attorney, Agent, or Firm*—R. M. Heald; C. D. Brown; W. K. Denson

[57] ABSTRACT

An antenna system and technique for laminating a dielectric substrate 14 to an antenna housing 12 which prevents separation of the dielectric substrate 14 from the housing 12. This is accomplished by confining an antenna assembly 10 inside a laminating fixture 24. Heat is then applied to the fixture 12. This causes the dielectric substrate 14 to become somwhat plastic and also to expand. This expansion results in great pressure being exerted between the dielectric 14 and the housing 12. When the assembly is allowed to cool the dielectric 14 adheres to the housing 12. This prevents separation of the housing 12 from the dielectric 14. The result is an antenna assembly 10 which can withstand large temperature extremes without causing an air gap between the dielectric 14 and the housing 12 which would distort the electrical signal transmitted or received by the antenna.

3 Claims, 2 Drawing Sheets

ANTENNA LAMINATION TECHNIQUE

CROSS-REFERENCE TO RELATED APPLICATIONS

This application has subject matter related to the copending application entitled, "TDD Antenna—Foil Formed, Substrate Loaded Laser Welded Assembly", Ser. No. 864,221 filed May 19, 1986, by N. Alfing and Bob Breithaupt.

BACKGROUND OF THE INVENTION

1. Technical Field

This invention relates to antenna systems and more particularly to techniques for laminating a dielectric substrate to an antenna housing.

2. Discussion

Conventional antenna designs, such as those utilized in missiles, are frequently large and bulky structures that are mounted inside of the missile. Aside from being bulky, these antennas have to be designed to radiate through an air space as well as through the wall of a missile. The result is that such antenna systems are often inefficient.

Antenna assemblies which will save space in missiles and which have simpler and less costly fabrication requirements have been described to some extent by the following United States patents, the disclosures of which are incorporated herein by reference: U.S. Pat. No. 3,798,652, issued to Willilams; U.S. Pat. No. 4,010,470, issued to Jones; U.S. Pat. No. 4,431,996, issued to Milligan; U.S. Pat. No. 4,494,121, issued to Walter et al; and U.S. Pat. No. 4,516,131, issued to Bayha. The above-cited references are exemplary in the art and disclose antenna systems employed in missiles, projectiles, and radomes of aircraft. Even in these examples, the fabrication of antenna assemblies used in missile systems typically are comparatively costly because of processes which include etching, machining and a number of plating operations.

To solve these problems, there has been developed a design of an antenna assembly which has simplified fabrication requirements and which occupies a reduced amount of space. This invention is described in the above-referenced, copending applilcation entitled, "TDD Antenna—Foil Formed, Substrate Loaded Laser Welded Assembly". That application discloses an antenna which is formed by building a shell housing using a punch press operation. This housing can be made of various materials including aluminum or stainless steel. A dielectric with a load and a connector fits into the housing. Then, a back is placed onto the assembly and the unit is enclosed by laser welding.

The above design allows the fabrication of the housing to be constructed with the antenna features built-in, and is simpler and less costly than prior designs. However, it has been found that intimate contact between the dielectric and the housing could not be consistently maintained. This results in an air gap between the dielectric and the aperture housing. This air gap introduces changes into the radio frequency (RF) pattern. The result is distortion of the RF signal.

Changes in temperature make the separation problem worse. When the antenna assemblies are installed into the interior of a missile they are wrapped in an epoxy material which must be cured at high temperatures. For example, this curing temperature may be above 375° F. Subjecting the antenna assembly to these temperatures has resulted in separation of the dielectric from the housing. Conventional methods such as using a bonding material to attach the dielectric to the housing are not generally feasible. This is because the bonding material itself would create an unacceptable gap between the dielectric and the housing.

Thus, it would be desirable to have a method of attaching the dielectric to the antenna housing which would maintain intimate contact between the two materials throughout a wide temperature range, such as between 600° F. and −65° F. The present invention is intended to satisfy this need.

SUMMARY OF THE INVENTION

The present invention provides an antenna system where the antenna housing is laminated to the dielectric substrate. This is accomplished by placing the antenna assembly into a fixture with a cavity that conforms to the outside dimensions of the antenna assembly. A cover is attached to the fixture to secure the antenna assembly within the fixture under slight pressure. Heat is then applied to the fixture containing the antenna assembly. The resulting combination of heat and pressure causes the dielectric material to become plastic at the housing-dielectric interface. The fixture and antenna assembly are then allowed to cool. Because of the resulting adhesion between the dielectric and the housing, the dielectric and housing become laminated. The antenna assembly can then withstand large temperature extremes without separation of the dielectric from the housing. Because there is intimate contact between the dielectric and the housing, the RF signal carried by the antenna will be free of the distortion which air gaps introduce.

BRIEF DESCRIPTION OF THE DRAWINGS

The various advantages and features of the present invention will become apparent to one skilled in the art from the detailed description of the preferred embodiment which makes reference to the following set of drawings.

DESCRIPTION OF THE PREFERRED EMBODIMENT

Figure 1A:
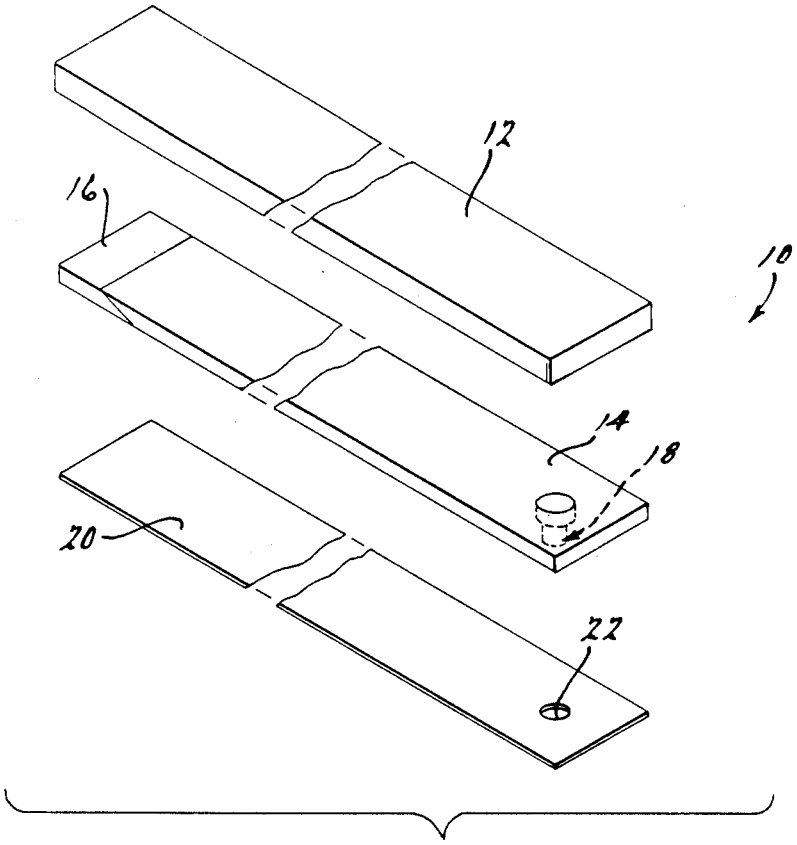
FIG. 1*a* is an exploded perspective view of the main components of the antenna assembly.

Referring to FIG. 1*a*, a drawing of an antenna assembly 10 according to the present invention, is shown. In FIG. 1*a*, a formed waveguide 12 is depicted. This waveguide 12 forms a shell housing which will contain the antenna components. The waveguide 12 is formed by punch-press construction techniques. It may be manufactured from a number of materials, including aluminum and stainless steel.

Also shown in FIG. 1*a* is the dielectric 14. This dielectric 14 is the load of the antenna element. The dielectric is characterized by having a low electrical conductivity. It may be made of a number of materials such as "Duroid" TM which is manufactured by Rogers Corporation of Phoenix, Ariz. Also, a ferrite load 16 is attached to one end of the dielectric 14. The ferrite load 16 absorbs RF energy. A metallic electrical connector 18 is attached to the other end of the dielectric 14 and protrudes out of that end.

Figure 1B:
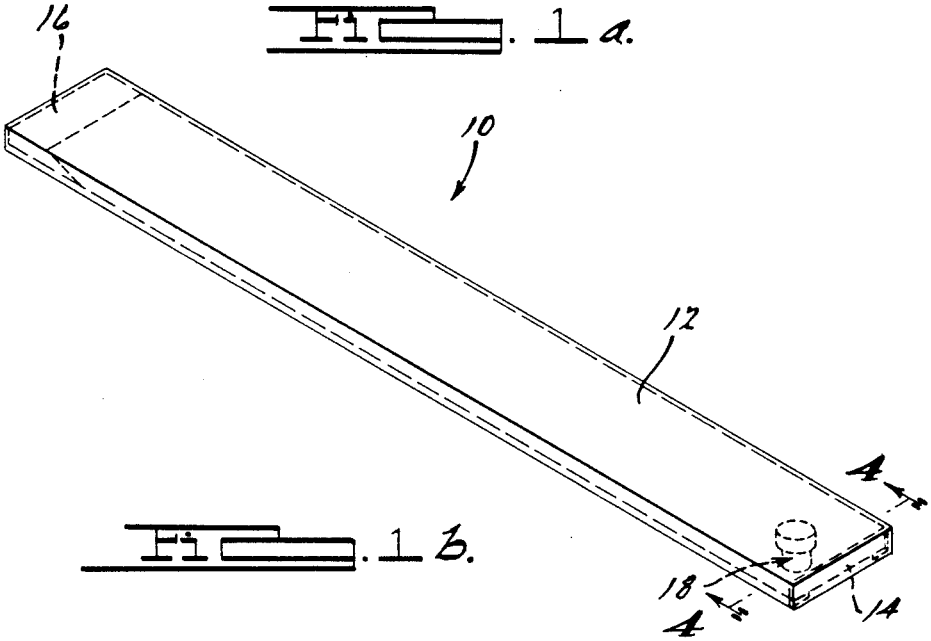
FIG. 1*b* is a perspective view of the assembled antenna.

The waveguide base plate 20 is also shown in FIG. 1*a*. This base plate 20 together with the housing 12 encapsulates the dielectric 14. Base plate 20 has an aperture 22 which aligns with the electrical connector 18 of the dielectric to permit the dielectric to be connected electrically with a transmitter or receiver. To assemble the antenna, the waveguide housing 12 is placed on the top of the dielectric 14 and base plate 20 is placed at the bottom of the dielectric 14. The base plate 20 and the waveguide housing 12 are then attached by any suitable means. For example, the waveguide housing 12 may be laser welded to the base plate 20. The antenna assembly can be composed of single dielectric elements as shown in FIG. 1*a* or parallel double elements may also be used. FIG. 1*b* shows the assembled antenna prior to the laminating process.

Figure 2:
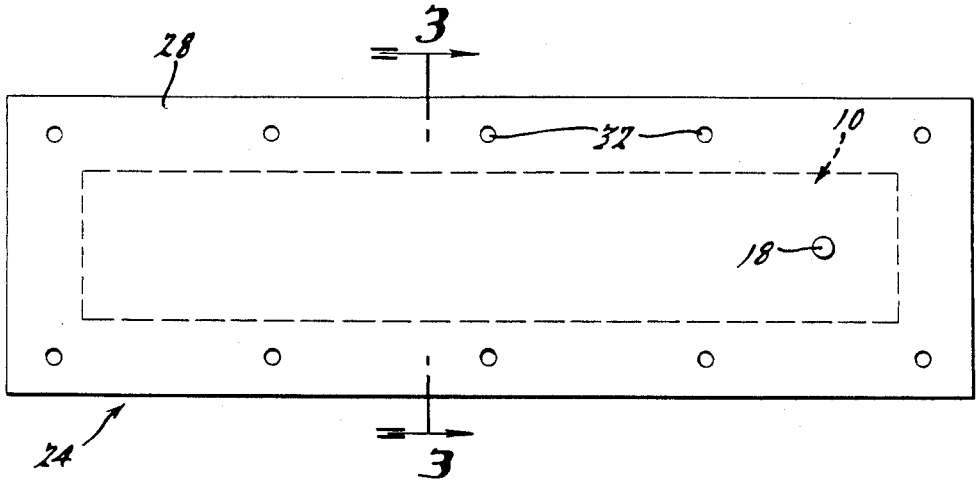
FIG. 2 is a drawing of the antenna assembly within the laminating fixture.
Figure 3:
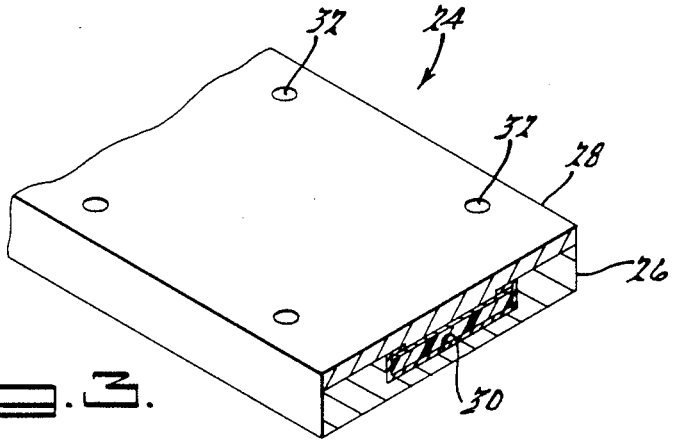
FIG. 3 is a partial perspective cross-sectional view taken along line 3—3 of FIG. 2 of the laminating fixture with the cover attached.

FIG. 2 and FIG. 3 illustrate the laminating fixture 24. The laminating fixture 24 comprises a bottom portion 26 and a cover plate 28. An interior cavity 30 in the bottom portion 26 is maintained to the finished size of the desired antenna dimensions, plus allowance for slight shrinkage of the assembly. For example, this allowance may be 0.002-inch for a one-inch width dimension.

When the antenna assembly 10 is placed inside the fixture bottom portion 26, the antenna assembly will be contained on five sides. Cover plate 28 is then placed on top of bottom portion 26 and the sixth remaining side of the antenna assembly will then be contained. Connector 18, however, will protrude through the fixture cover 28. Fasteners 32 are then used to lightly torque the cover plate 28 to the bottom portion 26. For example, a torque of 10 to 15-inch pounds may be used.

The laminating fixture 24 containing antenna assembly 10 is then heated. This may be accomplished by inserting the fixture 24 into an oven. In one embodiment, according to the present invention, the temperature is monitored and the fixture 24 containing antenna assembly 10 is heated to a temperature of 525° to 535° F. and held for 15 minutes. The precise temperature and duration of heating will vary according to the materials used for dielectric 14, waveguide housing 12 and base plate 20. After 15 minutes at the desired temperature the assembly is then cooled.

Figure 4:
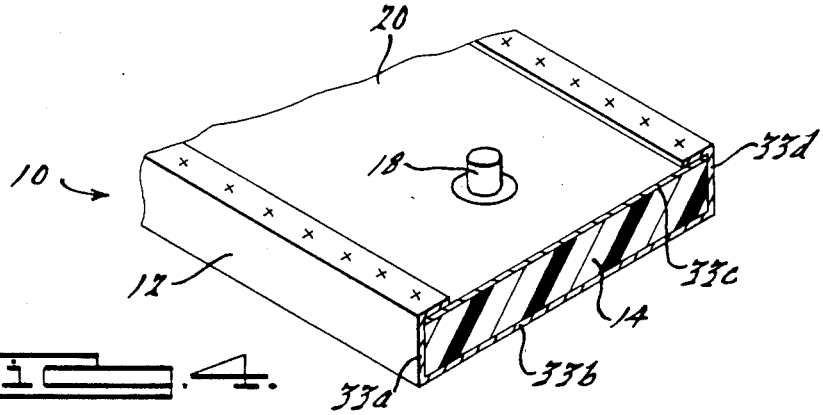
FIG. 4 is a partial perspective cross-sectional view taken along line 4—4 of FIG. 1*b* of the antenna assembly indicating the laminated surfaces.

During the heating process, the dielectric 14 becomes somewhat plastic or mastic. Furthermore, the coefficient of expansion the dielectric 14 is very large. As a result, during the heating process, because the antenna assembly 10 is constrained on all sides by the fixture 24, extreme force will be applied between the dielectric 14 and both the waveguide housing 12 and the base plate 20. This will result in adhesion of the dielectric 14 to the waveguide housing 12 and the base plate 20. It is thought that the adhesion results from either chemical or mechanical processes, or both, which result from the combination of temperature and pressure at the interface of the dielectric 14 and the waveguide housing 12. FIG. 4 illustrates the four surfaces 33*a* through 33*d* of the dielectric 14 and waveguide housing 12 interface 33*a*, 33*b*, 33*d*, and of the dielectric 14 and base plate 20 interface 33*c* which are laminated as a result of the above process.

Antenna assemblies made according to the present invention are capable of withstanding extreme temperatures without exhibiting separation of the dielectric 14 from the waveguide housing 12 and base plate 20. For example, antenna assemblies have been tested and function above 600° F. and down to −65° F. Those skilled in the art will come to appreciate that other advantages and modifications of the particular examples set forth herein are obtainable without departing from the spirit of the invention as defined from the following claims.

What is claimed is:

1. A process of laminating an antenna assembly comprising the steps of:

fabricating an antenna assembly having certain dimensions comprising a waveguide housing surrounding a dielectric substrate;

fabricating a fixture with a cavity having dimensions approximately the same as the dimensions of the antenna assembly;

inserting the antenna assembly into the fixture;

fastening a top plate to the fixture over said cavity containing the antenna assembly thereby confining the antenna assembly on all sides thereof;

applying sufficient heat to said fixture to cause the dielectric substrate to become tacky and to expand thereby resulting in pressure being exerted between the dielectric substrate and the waveguide housing; and allowing the fixture to cool whereby the dielectric substrate becomes laminated to the waveguide housing.

2. The process of claim 1 wherein the step of heating the fixture comprises:

increasing the amount of heat until the temperature reaches 525° to 535° F;

and holding the temperature relatively constant for about 15 minutes before allowing the fixture to cool.

3. The process of claim 1 wherein the step of fastening a top plate includes the step of torquing fasteners on the top plate to 10 to 15-inch pounds.

* * * * *